US009499310B2

(12) United States Patent
Fily

(10) Patent No.: US 9,499,310 B2
(45) Date of Patent: Nov. 22, 2016

(54) COMBINATION CHILD-RESISTANT PACKAGE AND COLLAPSIBLE TUBE, AND METHOD OF USING SAME

(71) Applicant: Galderma R&D, Sophia Antipolis (FR)

(72) Inventor: Sebastien Fily, Sophia Antipolis (FR)

(73) Assignee: Galderma Research & Development, Sophia Antipolis (FR)

( * ) Notice: Subject to any disclaimer, the term of this patent is extended or adjusted under 35 U.S.C. 154(b) by 449 days.

(21) Appl. No.: 13/729,195

(22) Filed: Dec. 28, 2012

(65) Prior Publication Data

US 2014/0183223 A1 Jul. 3, 2014

(51) Int. Cl.
*B65D 35/56* (2006.01)
*B65D 77/06* (2006.01)

(52) U.S. Cl.
CPC ..... *B65D 35/56* (2013.01); *B65D 77/06* (2013.01); *B65D 2215/00* (2013.01)

(58) Field of Classification Search
CPC ... B65D 35/56; B65D 77/06; B65D 2215/00
USPC ..... 222/105, 183, 490, 107, 95, 94, 92, 222/215, 153.1, 15.09, 153.14, 131; 215/11.3, 11.6; 220/23.87, 23.89, 23.9
See application file for complete search history.

(56) References Cited

U.S. PATENT DOCUMENTS

| | | | | |
|---|---|---|---|---|
| 2,556,584 A | | 6/1951 | Hofmann | |
| 2,711,766 A | | 6/1955 | Archer | |
| 2,793,012 A | | 5/1957 | Wolf | |
| D181,056 S | | 9/1957 | Jenkins | |
| D205,318 S | | 7/1966 | Meth | |
| 3,275,180 A | * | 9/1966 | Optner et al. | 206/521 |
| 3,464,599 A | | 9/1969 | Meth | |
| D218,289 S | | 8/1970 | Posada | |
| 3,540,628 A | * | 11/1970 | Trosch Armin | 222/183 |
| D219,571 S | | 12/1970 | Speers | |
| 3,777,925 A | | 12/1973 | Eckholm | |
| 3,868,036 A | | 2/1975 | Wittwer | |

(Continued)

FOREIGN PATENT DOCUMENTS

| | | |
|---|---|---|
| WO | 9425358 A1 | 11/1994 |
| WO | 2008102066 A1 | 8/2008 |

OTHER PUBLICATIONS

Int'l Search Report and Written Opinion issued Jul. 28, 2014 in Int'l Application No. PCT/US2013/077766.

(Continued)

*Primary Examiner* — Patrick M Buechner
(74) *Attorney, Agent, or Firm* — Panitch Schwarze Belisario & Nadel LLP

(57) ABSTRACT

A combination includes a child-resistant package and a collapsible tube removably positionable therein. A sidewall of a body of the package has an interior surface and an opposing exterior surface. A cavity is defined by the body. An opening is positioned proximate an open first end of the body. A bottom wall is positioned proximate an open second end of the body. A cap is removably mounted onto at least a portion of the first end of the body. The collapsible tube is surrounded by the body, the bottom wall and the cap when the cap is mounted onto at least a portion of the first end of the body. The collapsible tube includes a generally flexible housing defining a cavity for holding a substance to be dispensed from the housing. A closure is removably mounted onto the housing.

8 Claims, 4 Drawing Sheets

(56) References Cited

U.S. PATENT DOCUMENTS

| | | | | | |
|---|---|---|---|---|---|
| 4,174,051 | A | * | 11/1979 | Edwards | B65D 77/065 220/288 |
| 4,215,785 | A | * | 8/1980 | Schwaiger | 215/11.6 |
| D260,657 | S | | 9/1981 | Funahashi | |
| D267,234 | S | | 12/1982 | Lunden | |
| D286,674 | S | | 11/1986 | Hoyt | |
| D286,675 | S | | 11/1986 | Hoyt | |
| 4,706,827 | A | * | 11/1987 | Cabernoch et al. | 215/11.3 |
| D294,637 | S | | 3/1988 | Hoyt et al. | |
| D362,799 | S | | 10/1995 | Noble | |
| D410,842 | S | | 6/1999 | DiMarzo et al. | |
| 6,085,927 | A | | 7/2000 | Kusz | |
| 6,386,405 | B1 | | 5/2002 | Kars et al. | |
| 6,616,000 | B1 | * | 9/2003 | Renz | 215/11.1 |
| D483,671 | S | | 12/2003 | Pinnavaia | |
| D571,663 | S | | 6/2008 | Bakic | |
| D617,449 | S | | 6/2010 | Walker | |
| D659,540 | S | | 5/2012 | Bakic | |
| 2005/0054991 | A1 | | 3/2005 | Tobyn et al. | |

OTHER PUBLICATIONS

U.S. Appl. No. 29/468,260 by Fily, filed Sep. 27, 2013.
Office Action issued Sep. 11, 2015 in U.S. Appl. No. 29/468,260 by Fily.

* cited by examiner

COMBINATION CHILD-RESISTANT PACKAGE AND COLLAPSIBLE TUBE, AND METHOD OF USING SAME

BACKGROUND OF THE INVENTION

The present invention relates generally to a combination child-resistant package and collapsible tube and, more particularly, to a device capable of adding child-resistant functionality to collapsible tubes.

Collapsible tubes are a well known type of container. For example, collapsible tubes include toothpaste tubes and skin lotion tubes, which allow a user to store and selectively dispense a substance, such as toothpaste or lotion. Such containers are quite beneficial, as they are typically conveniently sized and resilient even after repeated use.

Most, if not all, conventional collapsible tubes are not child-resistant. In other words, conventional collapsible tubes do not typically include a mechanism that makes it difficult for children to open the tubes to gain access to the contents therein. It may be desirable to create such a feature for conventional collapsible tubes, especially in light of any new government regulations. Unfortunately, converting conventional collapsible tubes to include child-resistant features therein or thereon could be time consuming and expensive, at least because new studies and new molds would likely be required.

It has yet to be discovered how to quickly, easily and inexpensively add child-resistant functionality to collapsible tubes. In particular, it has yet to be discovered how to add child-resistant functionality to the existing size, shape and configuration of collapsible tubes. The present invention accomplishes these objectives.

BRIEF SUMMARY OF THE INVENTION

Briefly stated, one aspect of the present invention is directed to a combination having a child-resistant package including a body having a generally open first end, an opposing generally open second end, and a sidewall extending from the first end to the second end. The sidewall has an interior surface and an opposing exterior surface. A longitudinal axis of the body extends from the first end to the second end. A cavity is defined by the body. An opening is positioned proximate the open first end of the body. A bottom wall is positioned proximate the open second end of the body. The bottom wall generally closes the open second end of the body. A cap is removably mounted onto at least a portion of the first end of the body. The combination also has a collapsible tube that is removably positionable in the cavity of the body. The collapsible tube is surrounded by the body, the bottom wall and the cap when the cap is mounted onto at least a portion of the first end of the body. The collapsible tube includes a generally flexible housing defining a cavity for holding a substance to be dispensed from the housing. A closure is removably mounted onto the housing.

In another aspect, the present invention is directed to a method of using a child-resistant package for a collapsible tube. The method includes obtaining or providing a child-resistant package having a body and a cap removably attached to a first end thereof. The method includes inserting a collapsible tube into an open second end of the body and attaching a bottom wall to the open second end of the body to enclose the collapsible tube within the package.

In yet another aspect, the present invention is directed to a combination child-resistant package and collapsible tube. The child resistant package including a body having a first end, an opposing second end, and a sidewall extending from the first end to the second end. The sidewall has an interior surface and an opposing exterior surface. A longitudinal axis of the body extends from the first end to the second end. A cavity is defined by the body. An opening is positioned proximate to the first end of the body. A bottom wall is positioned proximate to the second end of the body. A cap is removably mountable onto at least a portion of the first end of the body. The collapsible tube is removably positionable in the cavity of the body. The collapsible tube includes a generally flexible housing defining a cavity for holding a substance to be dispensed from the housing and a closure removably mounted onto the housing. The collapsible tube is movable within the body along the longitudinal axis between a first position and a second position. In the first position, the entire collapsible tube is positioned below the first end of the body of the package. In the second position, at least a portion of the collapsible tube is positioned above the first end of the body of the package and extends outwardly beyond the package.

BRIEF DESCRIPTION OF THE SEVERAL VIEWS OF THE DRAWINGS

The foregoing summary, as well as the following detailed description of the invention, will be better understood when read in conjunction with the appended drawings. For the purpose of illustrating the invention, there are shown in the drawings embodiments which are presently preferred. It should be understood, however, that the invention is not limited to the precise arrangements and instrumentalities shown. In the drawings.

DETAILED DESCRIPTION OF THE INVENTION

Figure 1:
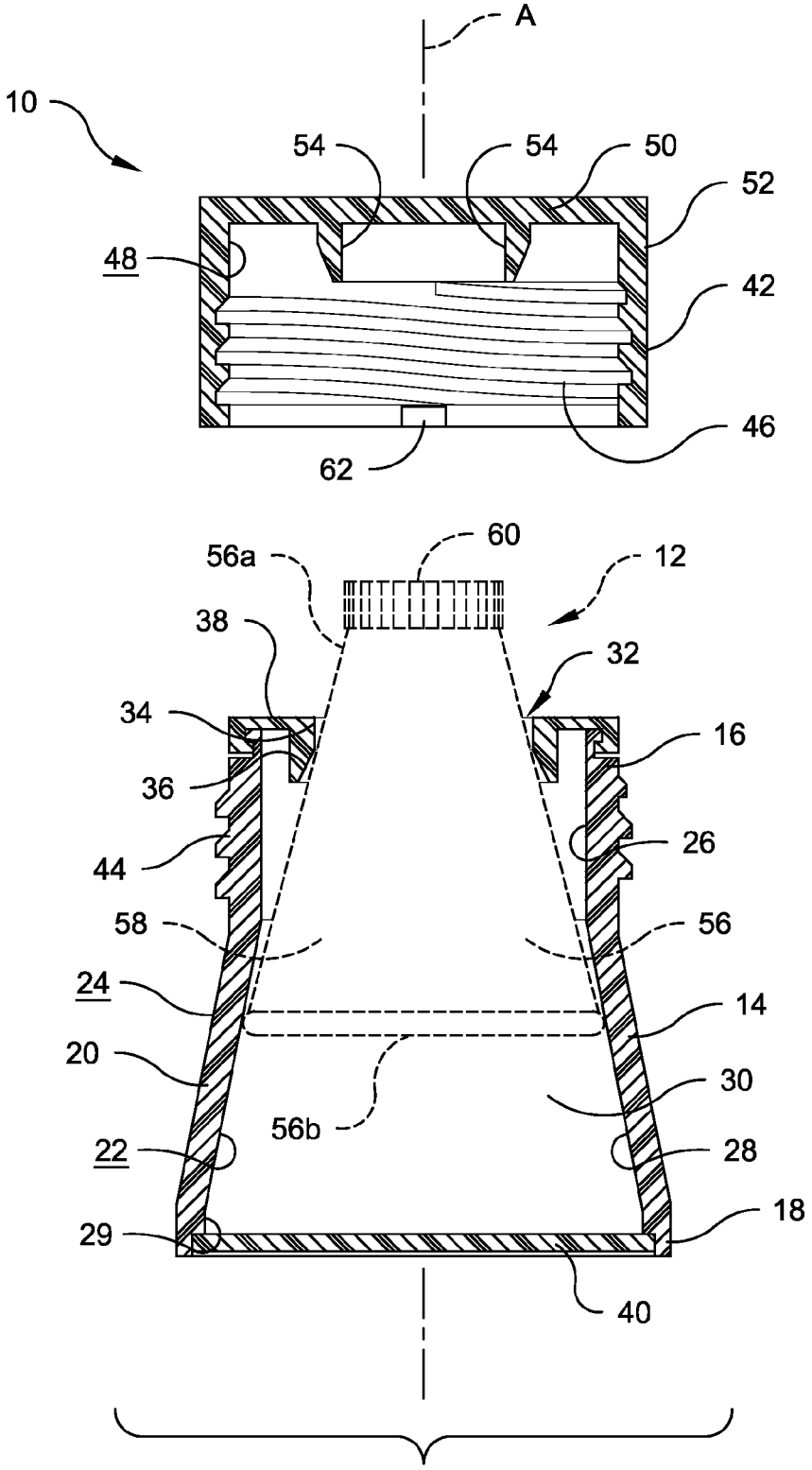
FIG. 1 is a cross-sectional, partial exploded side elevational view of a combination child-resistant package and collapsible tube in accordance with a preferred embodiment of the present invention, wherein a cap of the package is shown separated from a body of the package and the tube is shown moved upwardly with respect to the body.

Certain terminology is used in the following description for convenience only and is not limiting. The words "lower," "bottom" and "upper" designate directions in the drawings to which reference is made. The words "upwardly," "downwardly," "inwardly" and "outwardly" refer to directions toward and away from, respectively, the geometric center of the device, and designated parts thereof, in accordance with the present invention. Unless specifically set forth herein, the terms "a," "an" and "the" are not limited to one element, but instead should be read as meaning "at least one." The terminology includes the words noted above, derivatives thereof and words of similar import.

Referring to the drawings in detail, wherein like numerals indicate like elements throughout the several views, FIGS.

1-4 illustrate a combination child-resistant package, generally designated 10, and a collapsible tube, generally designated 12, in accordance with a first preferred embodiment of the present invention. The package 10 is preferably sized, shaped and/or configured to completely surround the tube 12 when desired, such that the package 10 protects and/or preserves the tube 12. The tube 12 is preferably able to be completely removed from the package 10, and the package 10 preferably allows access to the tube 12 to dispense at least some of a substance (not shown), such as a toothpaste or lotion, when desired, without requiring that the tube 12 be completely removed from the package 10.

Referring to FIGS. 1-4, the package 10 preferably includes a body 14 having a generally open first or upper end 16 and an opposing generally open second or lower end 18. A longitudinal axis A of the body 14 extends linearly from a geometric center of the first end 16 to a geometric center of the second end 18. Both the first and second ends 16, 18 are preferably at least generally circular when viewed from above or below (see FIG. 3). Each of the first and second ends 16, 18 preferably include a notch or groove 16*a*, 18*a*, respectively, therein. Each groove 16*a*, 18*a* may extend continuously and uninterrupted around an entire periphery of the body 14, or each groove 16*a*, 18*a* may be formed at one or more spaced-apart discrete locations on the body 14.

Figure 3:
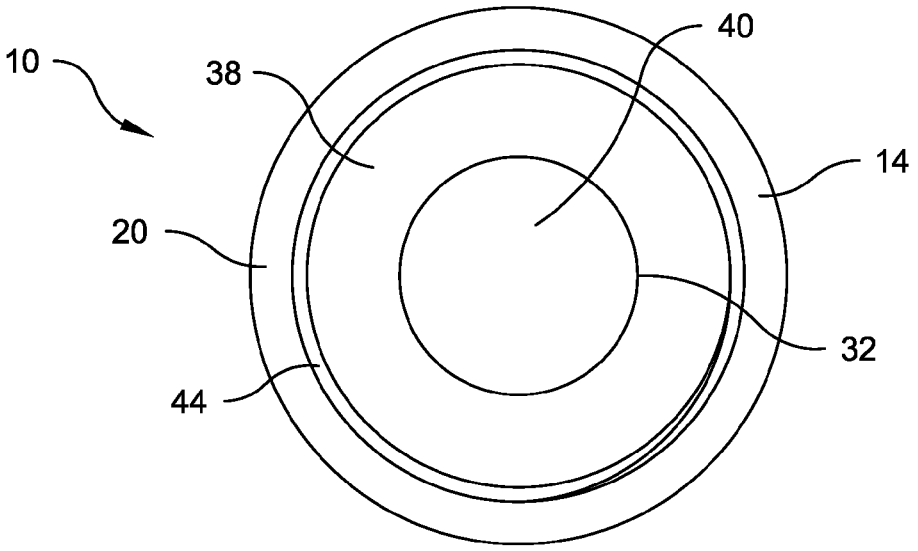
FIG. 3 is a top plan view of the combination, wherein the cap and the collapsible tube are omitted for clarity.

A sidewall 20 preferably extends from the first end 16 of the body 14 to the second end 18 thereof. The sidewall 20 includes an interior surface 22 and an opposing exterior surface 24. The interior surface 22 of the sidewall 20 preferably defines a cavity 30 within the body 14. As shown in FIG. 3, the body 14 preferably has a generally circular cross-section and/or outer periphery when viewed from above and/or below. However, the body 14 is not limited to such a shape and/or configuration, as the body 14 may have any shape, such as an elliptical cross-section, and/or configuration that permits the functionality described herein.

Figure 2:
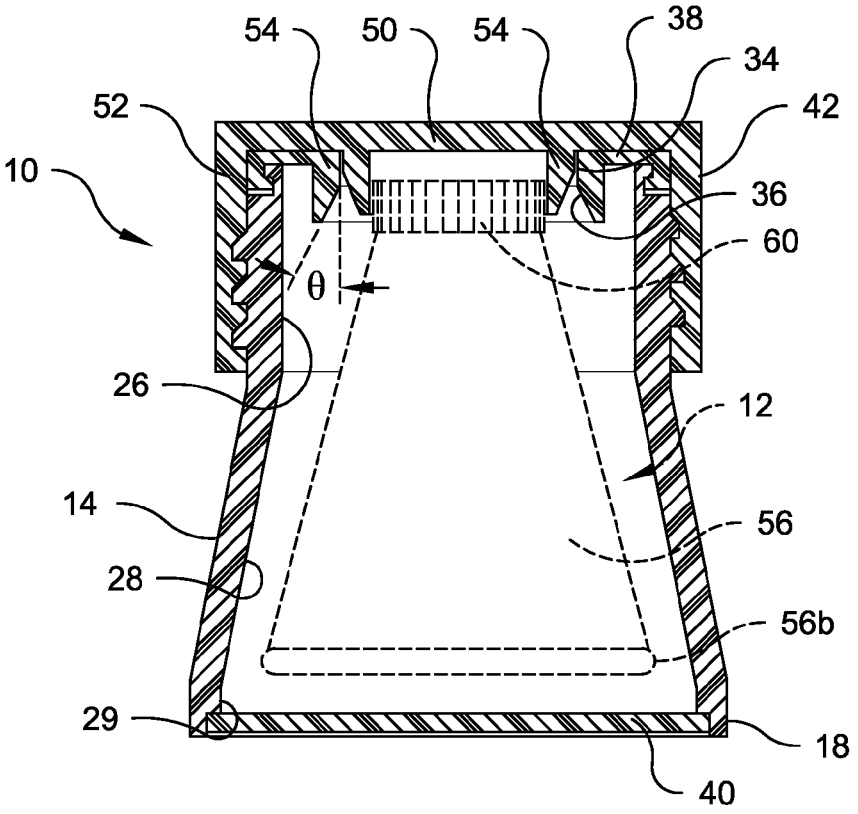
FIG. 2 is a partial cross-sectional side elevation view of the combination, wherein the tube is fully inserted into the body and the cap is attached to the body.
Figure 4:
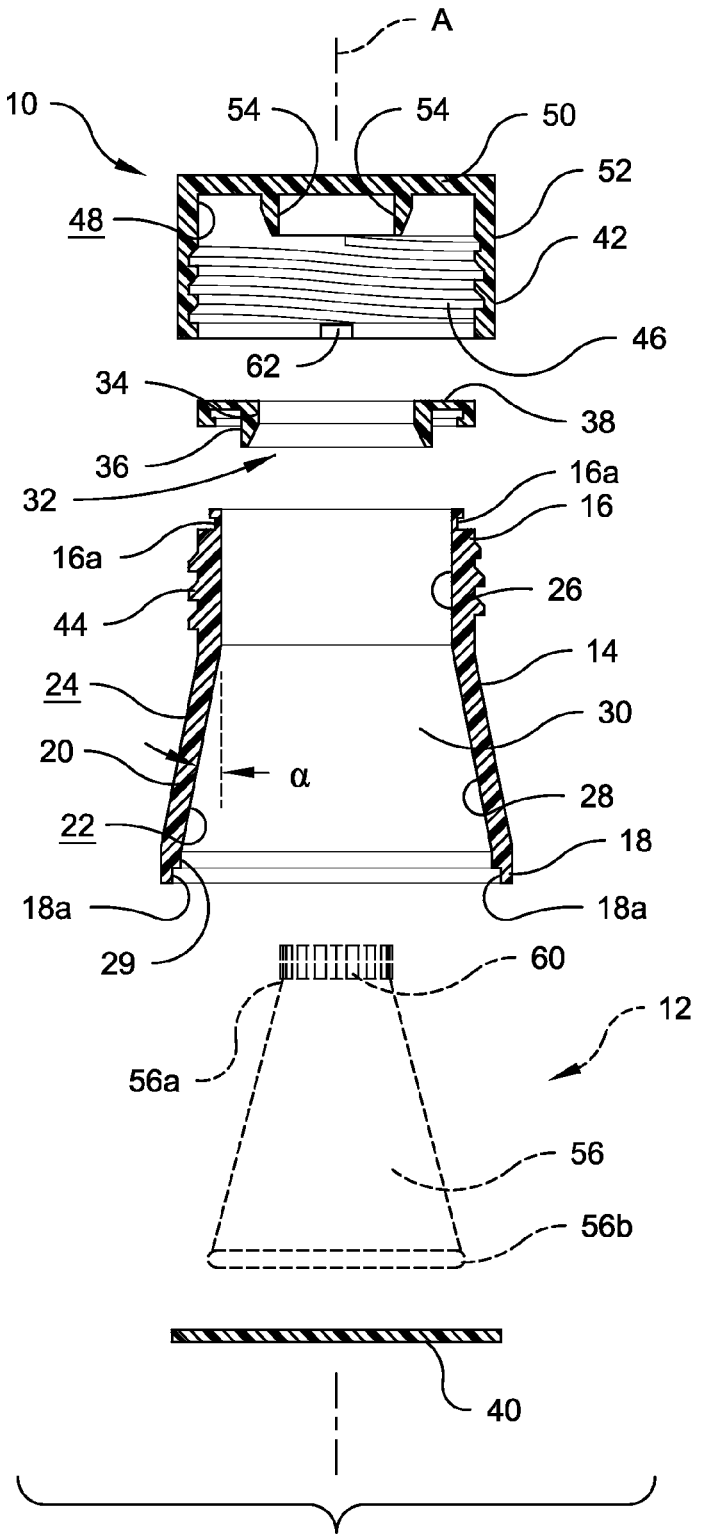
FIG. 4 is a partial cross-sectional, exploded side elevational view of the combination package and tube.

Referring to FIGS. 1, 2 and 4, the interior surface 22 of the sidewall 20 of the body 14 preferably has a first or upper portion 26 proximate the first end 16 of the body 14 and a second or lower portion 28 proximate the second end 18 of the body 14. The first portion 26 preferably has a smaller width, diameter and/or cross-sectional area then the second portion 28. At least a segment of the first portion 26, and preferably the entire first portion 26, extends at least generally, if not exactly, parallel to the longitudinal axis A. In other words, the first portion 26 preferably has a generally cylindrical shape. In contrast, at least a segment of the second portion 28 preferably extends at an angle $\alpha$ (see FIG. 4) that extends inwardly toward or away from the longitudinal axis A. In particular, the angle $\alpha$ is preferably approximately five to thirty degrees (5°-30°) with respect to the longitudinal axis A. In other words, at least a segment of the second portion 28 preferably has a generally inverted conical shape. The conical shape may be formed by circles or ellipses, for example. A lower-most segment 29 of the interior surface 22 of the sidewall 20 may have a generally cylindrical shape, such that the second portion 28 is positioned between and separated by two spaced-apart cylindrical sections 26, 29 of the sidewall 20. The lower most-segment 29 of the sidewall 20 preferably has a greater width, diameter and/or cross-sectional area than the first portion 26 of the sidewall 20. The above-described shape and/or configuration of the interior surface 22 of the sidewall 20 permits or allows the functionality described in more detail below. The shape and/or configuration of the exterior surface 24 of the sidewall 20 preferably matches that of the interior surface 22.

Referring to FIGS. 1-4, the package 10 preferably includes a collar 38 positioned at or near the first end 16 of the body 14. An outer periphery of the collar 38 is preferably at least generally circular when viewed from above or below (see FIG. 3). The collar 38 preferably snap-fits onto the first end 16 of the body 14, and the collar 38 is preferably removably mountable onto at least a portion of the first end 14 of the body 14. More specifically, at least a portion of an outer periphery of the collar 38 is complementary sized, shaped and/or configured to receive and/or engage at least a portion of the groove 16*a* in the first end 16 of the body 14. However, the collar 38 may be integrally, unitarily and/or monolithically formed with at least a portion of the body 14.

Referring again to FIGS. 1-4, the package 10 preferably includes an opening 32 position proximate the open first end 16 of the body 14. More particularly, the opening 32 preferably extends through a geometric center of the collar 38. When the collar 38 is attached to the first end 16 of the body 14, the open first end 16 of the body 14 is at least slightly closed, except for the opening 32. The opening 32 is preferably at least slightly smaller than the open first end 16 of the body 14. In other words, a width, diameter and/or cross-sectional area of the opening 32 is preferably at least slightly smaller than that of the open first end 16 of the body 14. As described in detail below, the opening 32 is preferably sufficiently sized, shaped and/or configured to allow a portion of the tube 12 to be removed from the package 10 through the first end 16 of the body 14 (see FIG. 1), but may prevents the entire tube 12 from being removed from the package 10 through the first end 16 of the body 14.

As shown in FIGS. 1, 2 and 4, the opening 32 preferably has a first or upper portion 34 and a second or lower portion 36. The first portion 34 is preferably positioned along the longitudinal axis A with respect to the second portion 36. In other words, the first portion 34 is positioned vertically above the second portion 36 when the package 10 is placed on a support surface (not shown), such as a countertop or table top. At least an interior surface of the first portion 34 of the opening 32 extends generally, if not exactly parallel, to the longitudinal axis A. Thus, the first portion 34 preferably has a generally cylindrical shape. At least an interior surface of the second portion 36 of the opening 32 preferably extends at an angle $\theta$ (see FIG. 2) that extends toward or away from the longitudinal axis A. The angle $\theta$ is preferably approximately forty five degrees (45°) with respect to the longitudinal axis A. Thus, the second portion 36 preferably has a generally inverted conical shape. The conical shape may be formed by circles or ellipses, for example.

Referring again to FIGS. 1, 2 and 4, the package 10 preferably includes a bottom wall 40 positioned at or near the open second end 18 of the body 14. When viewed from the side (see FIGS. 1, 2 and 4), the bottom wall 40 is preferably flat or planar. When viewed from above or below (see FIG. 3), an outer periphery of the bottom wall 40 is preferably at least generally circular. The bottom wall 40 is preferably a separate component from the body 14. The bottom wall 40 may snap-fit onto the open second end 18 of the body 14. In particular, at least a portion of an outer periphery of the bottom wall 40 preferably complementary engages the groove 18*a* at or within the open second end 18 of the body 14 with a tight interference fit. Thus, the bottom wall 40 is mountable to at least a portion of the open second end 18 of the body 14 to generally close the open second end 18 of the body 14 preferably after the tube 12 has been inserted into the body 14. A user or manufacturer may insert the tube 12 into the open second end 18 of the body 14 and then close the open second end 18 of the body 14 by attaching the bottom wall 40 thereto. However, the bottom wall 40 may be integrally, unitarily and/or monolithically formed with at least a portion of the body 14, either before or after the tube 12 is inserted into the body 12.

Referring to FIGS. 1, 2 and 4, the package 10 preferably includes a cap 42 that is removably mountable onto at least a portion of the open first end 16 of the body 14. As shown in FIG. 2, when the cap 42 is properly mounted onto the body 14, the collar 38 is preferably enclosed or otherwise sandwiched between the cap 42 and the body 14. The cap 42 preferably includes a generally flat or planar base wall 50 and a skirt 52 extending downwardly therefrom. The base wall 50 and the skirt 52 are preferably integrally, unitarily and/or monolithically formed and converge at a generally ninety degree (90°) angle.

At least one projection 54 preferably extends downwardly from the base wall 50. The projection 54 is preferably spaced-apart radially inwardly from the skirt 52. Thus, the skirt 52 generally surrounds an entire periphery of the projection 54. The skirt 52 preferably extends downwardly along the longitudinal axis A further than the projection 54 when the cap 42 is properly mounted to the body 14. The projection 54 may be a singular, arcuate structure that extends uninterrupted in a circle about a geometric center of the cap 42 when viewing the cap 42 from above or below. Alternatively, two or more spaced-apart projections 54 may extend downwardly from the base wall 50 on opposing sides of the geometric center of the cap 42. However, the projection(s) 54 is/are not limited to the above-described size, shape and/or configuration, as the projection(s) 54 may be in any form that is capable of accomplishing the functionality described in detail below.

Referring again to FIGS. 1, 2 and 4, a first thread 44 is preferably formed on at least a portion of the exterior surface 24 of the sidewall 20 of the body 14. Thus, at least a portion of the first thread 44 extends radially outwardly from the exterior surface 24. The first thread 44 is preferably located proximate the open first end 16 of the body 14. However, the first thread 44 is preferably spaced at least slightly downwardly from the open first end 16 of the body 14 along the longitudinal axis A. A second complementary thread 46 is preferably formed on an interior surface of the cap 42. In particular, the second complementary thread 46 is preferably formed on the interior surface 48 of the skirt 52. When the cap 42 is properly mounted onto a body 14, the first thread 44 preferably engages the second complementary thread 46.

The combination and engagement of the threads 44, 46 preferably provides and/or forms at least a portion of the child-resistant functionality, as is well known to those skilled in the art. The child-resistant feature may be overcome by simultaneously squeezing & turning the cap 42 with respect to the body 14, so as to disengage a projection or plug 62 (see FIGS. 1 and 4) extending inwardly from the skirt 52 of the cap 42 with a portion of the body 14 in a manner well known to hose skilled in the art. Alternatively or additionally, the cap 42 may be formed in two separate pieces (e.g., an inner cap and an outer cap) to enable "push & turn" functionality.

The package 10 and any of the components thereof are preferably formed of a generally rigid, high-strength, lightweight material. For example, the package 10 and any of the components thereof may be formed of a polymeric and/or metallic material. The package 10 and each of the components thereof are preferably formed of at least a generally opaque material. However, any portion of the package 10 may be formed of at least a generally transparent or translucent material, so that any item(s) within the cavity 30 may be at least partially visible from outside of the package 10.

The size, shape and/or configuration of the package 10 allows for multiple packages 10 to be stacked and/or packed in a relatively tight configuration. Such a feature is beneficial for storage, transportation and/or display purposes. The size, shape and/or configuration is similar to conventional medicate containers or bottles (not shown), such as an ADVIL bottle for holding pills. As a result, multiple packages 10 of the present invention can be stored, transported and/or displayed similar to well-known devices.

Referring to FIGS. 1, 2 and 4, the collapsible tube 12 preferably includes a generally flexible housing 56 that defines a cavity 58 for holding the substance to be dispensed from the housing 56. The housing 56 is preferably formed of an opaque, transparent or translucent polymeric material and is preferably generally flexible or elastically resilient. The housing 56 is preferably at least generally impermeable to liquids and gases, such that the substance within the cavity 58 can be preserved in a generally clean or sterile manner.

An upper end **56*a* of the housing 56 is preferably open and an opposing lower end 56*b* of the housing 56 is preferably crimped or sealed into a permanently closed position. The upper end 56*a* of the housing 56 preferably has a generally circular shape when viewed from above, while the lower end 56*b* preferably has a generally flat or planar shape when viewed from below. When viewed from the side, the housing 56 has a preferably angled, triangular or inverted conical shape, such that a width, diameter and/or cross-sectional area of the housing 56 at the upper end 56*a*, as measured generally perpendicularly to the longitudinal axis A, is preferably at least slightly smaller than that at the lower end 56*b*. In other words, a shape of an exterior surface of a sidewall of the housing 56 of the tube 12 generally matches or complements the shape of the second portion 28 of the interior surface of the sidewall 20 of the body 14 of the package 10**.

A generally rigid closure 60 is preferably removably mounted onto the housing 56 to enclose or otherwise seal the substance in the cavity 58. The closure 60 may be attached to the housing 56 in any one of a number of ways, such as by a conventional thread engagement (not shown) so that the closure 60 is twisted or rotated onto the housing 56. Alternatively, the closure 60 may attach to the housing 56 be a snap-fit and/or friction-fit configuration. While the above-described components, size, shape and/or configuration of the tube 12 is preferred, the tube 12 is not limited to the inclusion of such features. Instead, the tube 12 may be a container with any number of components in any size, shape and/or configuration, assuming that the tube 12 is capable of holding the substance and interacting with the package 10, as described herein.

Referring to FIGS. 1, 2 and 4, as described-above, the tube 12 is preferably partially and/or completely removably positionable in the cavity 30 of the body 14. In particular, when the tube 12 is properly positioned in the cavity 30 and the body 14, and when the package 10 is properly assembled (see FIG. 2), the tube 12 is preferably completely surrounded by the body 14, the bottom wall 40 and the cap 42 when the cap 42 is mounted onto at least a portion of the open first end 16 of the body 14. At least a portion of the tube 12, such as the closed end **56*b* thereof, preferably has a greater width, diameter and/or cross-sectional area than the opening 32 of the package 10. Such a configuration prevents the tube 12 from being completely removed from the body 14 through the first end 16 thereof once the tube 12 is properly inserted into the package 10. Further, at least a portion of the tube 12, such as the closure 60 and the open end 56***a* of the housing 56, preferably has a smaller width, diameter and/or cross-sectional area than the opening 32 of the package 10 to permit at least a portion of the tube 12 to be removed through the opening 32. Such a configuration maintains at least a portion of the tube 12 within the package 10, while allowing a user to dispense the substance from the tube 12. A plurality of different collars 38 may be formed, provided and/or attached to the body 14, each collar 38 including the opening 32 with a different size, shape and/or configuration, so that different types or sizes of tubes 12 can extend at least partially upward from and/or above the package 10.

As is evident when comparing FIGS. 1 and 2, the tube 12 is preferably movable within the body 14 along the longitudinal axis A between a first position (FIG. 2) and a second position (FIG. 1). The first position is preferably spaced-apart from the second position along the longitudinal axis A. In the first position, the entire tube 12 is preferably positioned below the open first end 16 of the body 14 of the package 10. Thus, in the first position, the tube 12 is entirely surrounded and protected by the package 10. In the first position, at least a portion of the projection 54 of the cap 42 extends into the opening 32 and surrounds or engages at least a portion of the closure 60 when the closure 60 is mounted onto the housing 56 and the tube 12 is properly positioned in the cavity 30 of the body 14.

In the second position, at least a portion of the tube 12 is positionable above the open first end 16 of the body of the package 10. As shown in FIG. 1, as the tube 12 is raised upwardly within the package 10, at least a portion of the housing 56 of the tube 12 preferably contacts the second portion 28 of the interior surface 22 of the body 14, thereby preventing further upward movement of the tube 12 with respect to the package 10 and/or removal of the tube 12 from the package 10. Alternatively or additionally, at least a portion of the housing 56 may contact the first portion 34 and/or the second portion 36 of the opening 32 as the tube 12 is raised upwardly within the package 10, thereby preventing further upward movement of the tube 12 with respect to the package 10. In the second position, a user can preferably remove the closure 60 from the housing 56 and is able to compress a portion of the tube 12 to dispense the substance from the housing 56 through the upper end 56*a* thereof.

It is envisioned that the user or consumer would receive or otherwise purchase the package 10 and the tube 12 in the fully assembled configuration shown in FIG. 2. In order to access the substance within the tube 12, it is preferred that the user remove the cap 42 from the body 14 by simultaneously pushing and turning or squeezing and turning the cap 42 with respect to the body 14. Once the child-resistant feature is overcome, it is preferred that the cap 42 is separated from the body 14 to allow the tube 12 to be moved upwardly with respect to the body 14 to expose at least a portion of the tube 12, such as the upper end 56*a* of the housing 56 (see FIG. 1). Next, the closure 60 is preferably removed from the housing 56 and at least some of the substance within the tube 12 is preferably removed therefrom, such as by squeezing at least a portion of the housing 56 of the tube 12. The closure 60 is preferably then reattached to the housing 56 of the tube 12 to reseal any remaining substance within the cavity 58 thereof. Once a sufficient amount of the substance is removed from the tube 12, it is preferred that the tube 12 is preferably moved downwardly with respect to the body 14 so that the entire tube 12, including the closure 60, is surrounded by the body 14. The cap 42 is then preferably attached to the open first end 16 of the body 14 to enclose the entire tube 12 within the package 10.

The above-described steps may be repeated as long as at least some of the substance remains within the tube 12. However, at some point it is expected that all of the substance will be removed or otherwise dispensed from the cavity 58 of the tube 12. At that point, it may be desirable to replace the tube 12 with another collapsible tube 12 that is filled with the substance. In that case, it would be desirable to completely remove the spent, original tube 12 from the package 10 to either dispose of, recycle, or refill the original tube 12 with a substance.

One way to do so is to remove the cap 42 from the open first end 16 of the body 14. Next, it is preferred that the collar 38 is removed and separated from the open first end 16 of the body 14. The spent, original tube 12 can then be removed from the body 14 and either refilled with additional substance, discarded or recycled. The refilled tube 12 or a new tube 12 can be inserted into the body 14. The collar 38 can then be re-attached to the body 14 and the cap 42 can be re-attached to the body 14 to enclose the collar 38 and the tube 12 therein. Another way to remove the spent tube 12 from the package 10 is to remove the bottom wall 40 from the body 14 and removing the tube 12 from the package 10 through the open second end 18 of the body 14

A method of assembling the package 10 and the tube 12 includes obtaining or providing the child-resistant package 10 with the cap 42 attached to the body 14. It is preferred that the tube 12 is inserted into the open second end 18 of the body 14 before the bottom wall 40 is attached to the open second end 18 of the body 14. Once the tube 12 is fully inserted into the body 14, it is preferred that the bottom wall 40 is attached to the open second end 18 of the body 14 to enclose the tube 12 within the package 10. Alternatively, the package 10 may be obtained or provided with the bottom wall 40 attached to the body 14. The tube 12 may be inserted into the first end 16 of the body 14. The collar 38 may then be attached to the first end 16 of the body 14. Finally, the cap 42 may be attached to the first end 16 of the body 14.

A method of using the package 10 and the tube 12 includes removing the cap 42 from the body 14. The tube 12 is then preferably moved with respect to the body 14 generally along the longitudinal axis A to expose at least the closure 60 and at least a portion of the upper end 56*a* of the housing 56. At least some of the substance within the tube 12 is preferably removed therefrom, such as by removing the closure 60 and squeezing at least a portion of the exposed housing 56. The closure 60 is then preferably reattached to the housing 56, and the tube 12 is preferably moved inwardly into the cavity 30 of the body 14 generally along the longitudinal axis A until the entire tube 12 is surrounded by the body 14. The cap 42 is then preferably reattached to the open first end 16 of the body 14 to enclose the entire tube 12 within the package 10.

When the tube 12 requires replacement or replenishment of the substance, the cap 42 is preferably removed from the body 14. The collar 38 is then preferably removed from the open first end 16 of the body 14, and the tube 12 is removed from the body 14 to discard or refill the tube 12 with the substance. Alternatively, to discard or refill the tube 12, the bottom wall 40 may be removed from the open second end 18 of the body 14 without removing the cap 42 and the collar 38 from the body 14.

Figure 5:
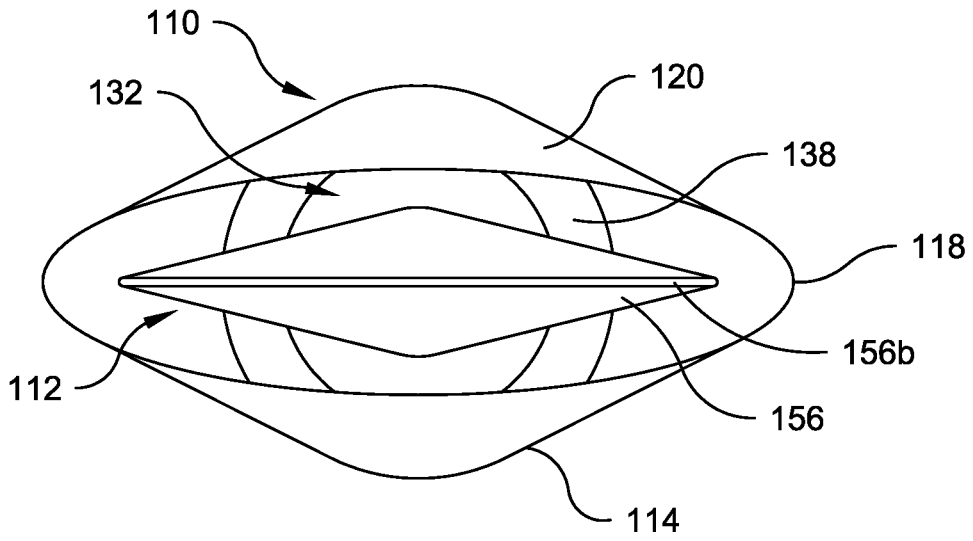
FIG. 5 is a bottom plan view of the combination package and tube in accordance with an alternative preferred embodiment of the present invention, wherein the cap and the bottom wall are omitted for clarity.

FIG. 5 illustrates an alternative preferred embodiment of the combination child-resistant package 110 and collapsible tube 112. The reference numerals of the alternative embodiment are distinguishable from those of the first embodiment by a factor of one-hundred (100), but otherwise indicate the same elements as indicated in the first embodiment, except as otherwise specified. The combination child-resistant package 110 and collapsible tube 112 of the alternative embodiment is substantially similar to that of the first embodiment. The description of certain similarities between the embodiments may be omitted herein for the sake of brevity and convenience, and, therefore, is not limiting.

A distinguishing feature of the alternative embodiment is that at least a lower portion of the sidewall 120 of the body 114 has a generally elliptical or oval shape when viewed from below, while an opposing upper portion of the sidewall 120 of the body 114 has a generally circular shape when viewed from below. Thus, the body 114 may be designed to more closely or even exactly match and/or complement a shape of the tube 112. As evident from the alternative embodiment, the body 114 may have any number of sized, shapes and/or configurations, and the present invention is not limited to one particular design or arrangement of the body 114.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. A combination comprising:

a child-resistant package including:

a body having a generally open first end, an opposing generally open second end, and a sidewall extending from the first end to the second end, the sidewall having an interior surface and an opposing exterior surface, a longitudinal axis of the body extending from the first end to the second end, a cavity being defined by the body, an opening positioned proximate the open first end of the body, the opening being smaller than the open first end of the body;

a bottom wall mountable to at least a portion of the open second end of the body for generally closing the open second end of the body;

a cap removably mountable onto at least a portion of the first end of the body; and a collapsible tube removably positionable in the cavity of the body and surrounded by the body, the bottom wall and the cap when the cap is mounted onto at least a portion of the first end of the body, the collapsible tube including:

a generally flexible housing defining a cavity for holding a substance to be dispensed from the housing;

a closure removably mounted onto the housing; and a collar removably mountable onto at least a portion of the first end of the body, the opening extending through the collar, the collar being engageable with the collapsible tube with the cap removed from the body, and the collar being disengaged from the collapsible tube inside a fully assembled child-resistant package with the cap mounted onto the body.

2. The combination according to claim 1, wherein the opening has a first portion and a second portion, the first portion extending generally parallel to the longitudinal axis, the second portion extending at an angle of approximately 45 degrees with respect to the longitudinal axis.

3. The combination according to claim 1, wherein the collapsible tube is movable within the body along the longitudinal axis between a first position and a second position, the first position being spaced-apart from the second position along the longitudinal axis, in the first position the entire collapsible tube being positioned below the first end of the body of the package, in the second position at least a portion of the collapsible tube being positioned above the first end of the body of the package and extending outwardly beyond the package.

4. The combination according to claim 1, wherein the cap includes a base wall and a skirt extending downwardly therefrom, at least one projection extending downwardly from the base wall, the projection being spaced-apart from the skirt, at least a portion of the projection surrounding at least a portion of the closure when the closure is mounted onto the housing and the collapsible tube is positioned in the cavity of the body.

5. The combination according to claim 1, wherein the interior surface of the sidewall of the body has a first portion proximate the first end of the body and a second portion proximate the second end of the body, the first portion extending generally parallel to the longitudinal axis, the second portion extending at an angle which extends inwardly toward the longitudinal axis.

6. The combination according to claim 1, wherein at least a portion of the collapsible tube is larger than the opening to prevent the collapsible tube from being completely removed from the body.

7. The combination according to claim 1, wherein at least a portion of the collapsible tube is smaller than the opening to permit at least a portion of the collapsible tube to be moved through the opening.

8. The combination according to claim 1, wherein the child-resistant package further includes:

a first thread on the exterior surface of the sidewall of the body proximate the first end thereof; and a second complementary thread on an interior surface of the cap, wherein the first thread engages the second thread when the cap is mounted onto the body.

* * * * *